United States Patent [19]

List

[11] Patent Number: 4,892,065

[45] Date of Patent: Jan. 9, 1990

[54] METHOD CONCERNING THE DELIVERY OF FUEL INTO THE COMBUSTION CHAMBER OF A DIESEL ENGINE AND A DEVICE FOR REALIZING THE METHOD

[75] Inventor: Hans List, Heinrichstrasse 126, A-8010 Graz, Austria

[73] Assignee: AVL Gesellschaft Für Verbrennungskraftmaschinen und Messtechnik M.B.H. Prof. Dr.Dr.H.C. Hans List, Graz, Austria

[21] Appl. No.: 357,895

[22] Filed: May 25, 1989

Related U.S. Application Data

[60] Division of Ser. No. 96,782, Sep. 14, 1987, Pat. No. 4,846,114, which is a continuation of Ser. No. 778,069, Sep. 20, 1985, abandoned.

[51] Int. Cl.[4] ..... F02B 13/02

[52] U.S. Cl. ..... 123/26; 123/531; 123/532; 239/88; 239/533.3

[58] Field of Search ..... 123/26, 531–534; 239/88–91, 533.3–533.12

[56] References Cited

U.S. PATENT DOCUMENTS

| | | | |
|---|---|---|---|
| 1,466,085 | 8/1923 | Buschke | 123/532 |
| 2,710,600 | 6/1955 | Nallinger | 123/533 |
| 2,950,707 | 8/1960 | Butler | 123/26 |
| 4,168,804 | 9/1979 | Hofmann | 239/533.11 |

FOREIGN PATENT DOCUMENTS

| | | | |
|---|---|---|---|
| 196352 | 4/1923 | United Kingdom | 123/532 |
| 296747 | 9/1928 | United Kingdom | 123/531 |

*Primary Examiner*—Andrew M. Dolinar
*Attorney, Agent, or Firm*—Watson, Cole, Grindle & Watson

[57] ABSTRACT

The delivery of fuel into the combustion chamber of a diesel engine is aided by blowing in an amount of compressed air which is small compared to the stroke volume of the diesel engine after the stream of fuel has been injected into the combustion chamber via the fuel nozzle. In this way fuel particles which would otherwise remain in the injection nozzle and considerably increase the hydrocarbon content of the exhaust are removed from the nozzle and burned, at the same time clearing the nozzle holes of any remaining fuel. The compressed air blown in after fuel injection will assist combustion of the red-hot particles of the fuel stream which have formed immediately beyond the nozzle.

3 Claims, 2 Drawing Sheets

METHOD CONCERNING THE DELIVERY OF FUEL INTO THE COMBUSTION CHAMBER OF A DIESEL ENGINE AND A DEVICE FOR REALIZING THE METHOD

This application is a divisional application of application Ser. No. 096,782, filed Sept. 14, 1987, now U.S. Pat. No. 4,846,114, which was a continuation of application Ser. No. 778,069, filed Sept. 30, 1985, now abandoned.

BACKGROUND OF THE INVENTION

This invention relates to a method for delivery of fuel into the combustion chamber of a diesel engine with which both fuel and compressed air are admitted by an injection nozzle, and equipment for realizing this method.

DESCRIPTION OF THE PRIOR ART

If fuel is injected into the combustion chamber of a diesel engine through the usual round-hole nozzles a smooth stream is ejected from the nozzle orifice which expands conically for a short distance and is then followed by a part that is also conical but whose surface is roughened by the air that is carried along. Ignition first takes place in this part. It propagates at high velocity in the direction of the stream and at a lower velocity against it. Against the direction of the stream the flame travels up to the smooth part. The smooth part does not burn during injection, apparently due to a lack of oxygen. It does leave individual sparks after the injection process, however, which are probably caused by unburned particles, such as coke particles.

SUMMARY OF THE INVENTION

This is the point of departure of the present invention whose aim it is to burn up the fuel as completely as possible and to minimize noxious emissions. Basically, the invention provides that the fuel stream which is injected into the combustion chamber via the fuel nozzle should be followed by a quantity of compressed air which is small compared to the stroke volume of the diesel engine. In this way fuel particles which would otherwise remain in the injection nozzle and which are responsible to a high degree for the hydrocarbons contained in the exhaust gases, are removed from the nozzle and burned, during which process the nozzle holes are cleared of fuel as well. Besides, the compressed air which is blown through after the fuel will aid combustion of the red-hot particles of the fuel stream that have formed immediately beyond the nozzle.

The invention thus is concerned with a method of direct fuel injection in which the fuel is injected under high pressure either by a separate pump and a fuel line, or by a pump which is integrated with the injection nozzle. The energy required for the injection process is solely delivered by this pump, and no additional air is introduced during injection.

A contrast to the above is presented by conventional air injection methods in which a certain quantity of fuel, which is metered by a separate pump, is delivered to the nozzle unit, from where it is blown into the combustion chamber by means of compressed air. This produces a mixture of fuel and air; the main energy source for pushing the fuel into the combustion space being the compressed air. This method is complicated in view of the separate compressor required in addition to the fuel metering pump. In this known system of air injection the pressure of the fuel is less important; usually, it is lower than the air pressure needed for injection. The relatively small amount of compressed air necessary for the method according to the invention may be obtained without the use of a separate compressor.

A particularly simple realization of the invention is achieved by taking the compressed air which is blown in after the fuel from the cylinder chamber of the diesel engine, preferably at a time of high pressure in this area, and storing it until injection time. In this variant no separate compressor is needed for the compressed air, whose higher temperature has a favorable influence on the injection process according to the invention.

In a device for realizing the method of the invention a check valve is provided at the cylinder for taking compressed air from the cylinder chamber of the diesel engine, which valve communicates via a line with an air cell, which may be heat insulated. The air cell in turn may be connected with the openings of the injection nozzle via channels and a control unit operating in dependence of the pressure in the air cell and the pressure in the fuel feeder bore of the injection nozzle, the control unit connecting the openings of the injection nozzle either with the air cell or with the fuel feeder bore, depending on the pressure level in the air cell and in the fuel feeder bore of the injection nozzle. Thus, compressed air is taken from the cylinder when a suitable level of pressure has been reached in the cylinder. As the compressed air is only required when the injection of fuel has terminated and the pressure in the cylinder has dropped during the expansion phase, the compressed air is stored in the state in which it was taken during the compression stroke and is fed back to the cylinder at a later time. This is done automatically via the control unit, depending on the pressure in the air cell and that in the fuel feeder bore in the injection nozzle. No separate compressor is required for this purpose.

In a favorable development of this device the injection valve is configured as a lapped-in fuel needle with a conical seat, and the fuel is fed to the nozzle holes through a ring-shaped groove in the fuel needle connected with a center bore, and the air feeder line from the second check valve is linked to the ring-shaped groove.

A preferred variant of the invention provides that the check valve, the bore and the air cell be located in the cylinder head and that connections and bores lead from the air cell to the second check valve in the nozzle body. This design is suitable for a pump/nozzle unit as well as for a configuration with a separate injection pump.

For the separate arrangement of pump and nozzle, but also for an integrated pump/nozzle design, a further development of the device is particularly suited, wherein the injection valve comprises a lapped-in fuel needle with a conical seat and a center bore for feeding fuel to the nozzle holes, and is further provided with a cross-bore in which slides a cylindrical valve body or similar element whose length is shorter by at least half the diameter of the center bore of the nozzle than half the length of the cross-bore, and wherein the cross-bore is connected (a) to the fuel feeder line of the injection nozzle, and (b) to the connecting channel towards the air cell. Instead of the cylindrical slide a ball could be used which should fit tightly into the bore. In this variant the injection of fuel and that of compressed air following the fuel are distinctly separated, which will enhance the efficiency of the system.

DESCRIPTION OF THE DRAWINGS

Following is a more detailed description of the equipment according to the invention, as illustrated by the accompanying drawings, in which.

DETAILED DESCRIPTION OF THE PREFERRED EMBODIMENTS

Figure 1:
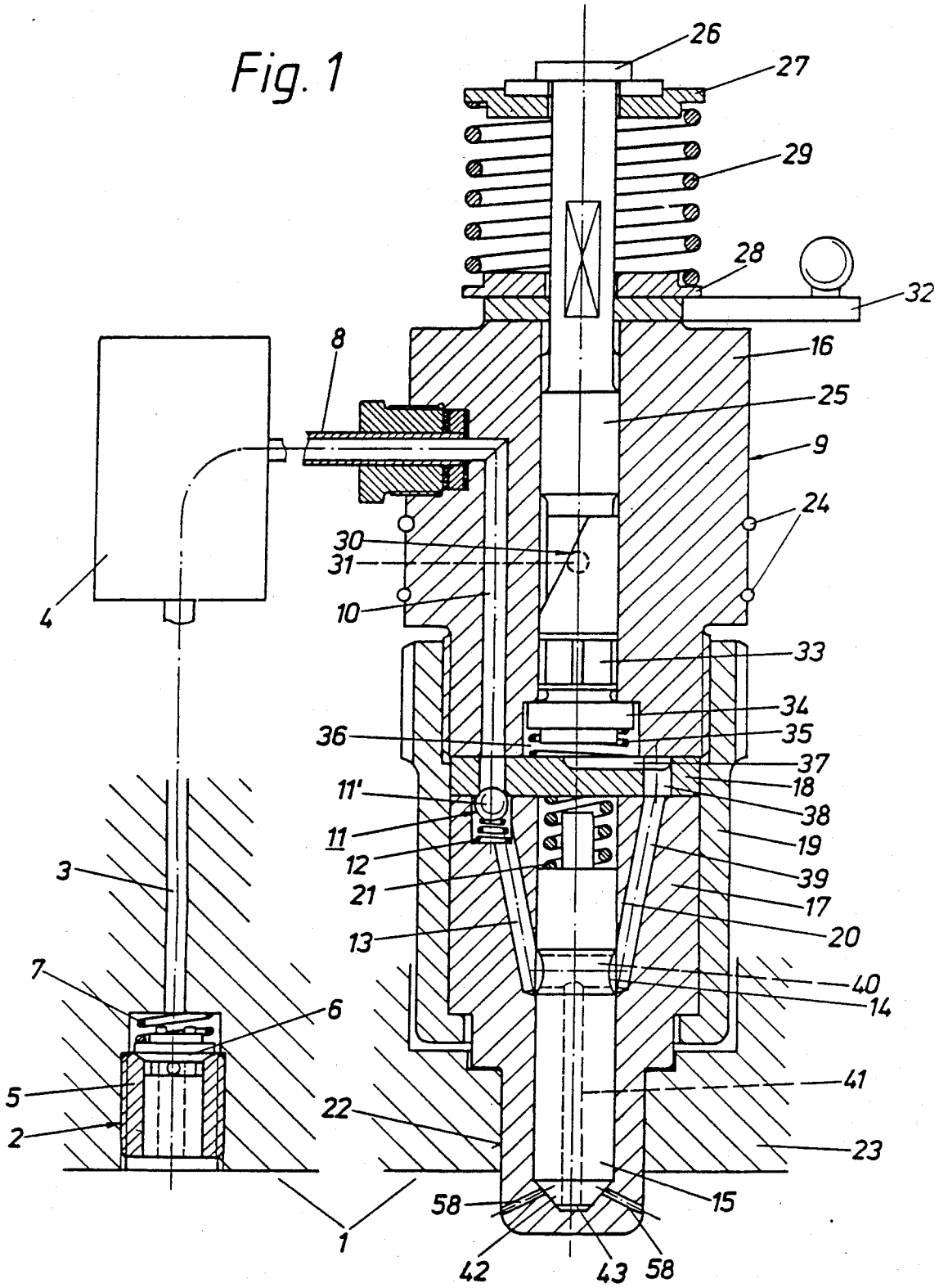
FIG. 1 shows a device for delivery of fuel and compressed air into a combustion chamber according to a first embodiment of the invention the device comprising a pump/nozzle unit.

From the cylinder chamber 1 air or a lean fuel/air mixture is delivered via the check valve 2 and a connecting bore 3 to an air cell 4 on account of the excess pressure in the cylinder. The check valve 2 has a ring 5, a valve disk 6 and a helical spring 7 whose load on the valve disk 6 is such that the check valve will open only when the excess pressure in the cylinder has reached a certain limit. From the air cell 4 a connection line 8 leads to the pump/nozzle unit 9 in which a bore 10 leads to a second check valve 11 which in this variant consists of a ball 11' loaded by a helical spring 12; other designs of the check valve are possible. The second check valve 11 communicates with the ring-shaped groove 14 in the fuel needle 15 through a bore 13.

The pump/nozzle unit 9 comprises a pump body 16 and a nozzle body 17, between which is inserted a plate 18 polished on both sides, and which are fastened together by means of a screw sleeve 19. The nozzle body 17 has an axial bore 20 starting at the end adjacent to plate 18, in which the fuel needle 15 is guided axially. The entire pump/nozzle unit may be inserted into a bore 22 at the cylinder head 23 of the diesel engine, and may be sealed by the sealing rings 24 carried by the pump body 16. The pump plunger 25 is fitted into the pump body 16 in such a way that it may be moved axially. It is actuated by a cam (not shown) acting on its top 26, which top 26 is pre-loaded by a spring 29 via washers 27, 28.

For control of the quantity of fuel injected the pump plunger 25 has a conventional sloping edge 30 which cooperates with the bypass port 31. By means of the lever 32 the pump plunger 25 may be turned, thus regulating the amount of fuel injected. The fuel metered in this way passes through the relief valve 33 which is provided with a valve disk 34 against which is pressing the load spring 35. The relief valve 33 opens into the chamber 36 which is connected with the feeder bore 39 in the nozzle body 17 via the groove 37 and a bore 38 in plate 18. Starting from plate 18 the feeder bore 39 opens into a ring space which is situated between nozzle body 17 and fuel needle 15 and is formed by a recess in the needle, and which is bounded by the ring-shaped groove 14 and the nozzle body 17. In the area of the ring-shaped groove 14 the fuel needle 15 has a cross-bore 40 which is connected with the axial bore 41 of the needle 15 opening into a pressure chamber 43 in the nozzle body 17 on the side away from the cross-bore, i.e., at the conical front end 42 of the fuel needle 15.

The bore 13 starting at the second check valve 11 communicates with the ring space formed by the ring-shaped groove 14 and the nozzle body 17 in the same way as the fuel feeder bore 39.

Figure 2:
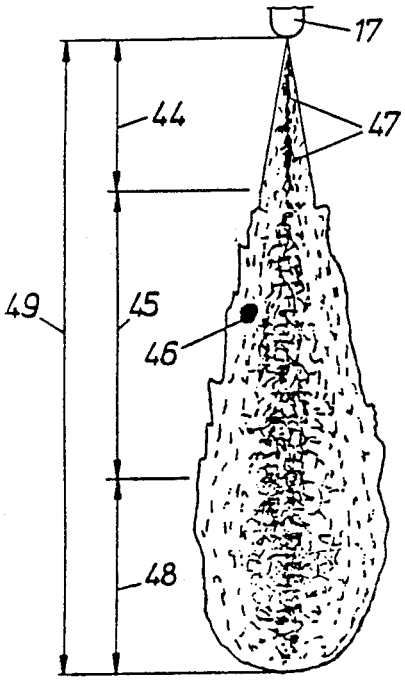
FIG. 2 presents a simplified view of a fuel stream.

The stream of fuel which is ejected from a bore 58 of the nozzle body 17 has the shape presented in FIG. 2. In the initial part 44 it is conical, with a smooth surface. Further on, mixing takes place with the air streaming in from the sides. This mixing zone has the number 45. Combustion approximately begins at the point marked 46, propagating in either direction: downwards at a higher, and upwards at a lower rate. At the initial part 44 it comes to a standstill, i.e., it does not propagate further towards the nozzle.

Whereas below the initial part 44 the stream will burn due to its mixing with air, sparks 47 will develop in the upper part, i.e., in the initial part 44, probably consisting of carbon particles of coke or soot.

By blowing in air according to the invention, oxygen is added to these particles of coke or soot whose temperatures are high enough to make them burn up partially or even completely as a consequence.

For the sake of completeness the dilution zone of the fuel stream is indicated by 48, and the overall length, i.e., the length of penetration of the fuel stream, is marked 49.

Figure 3:
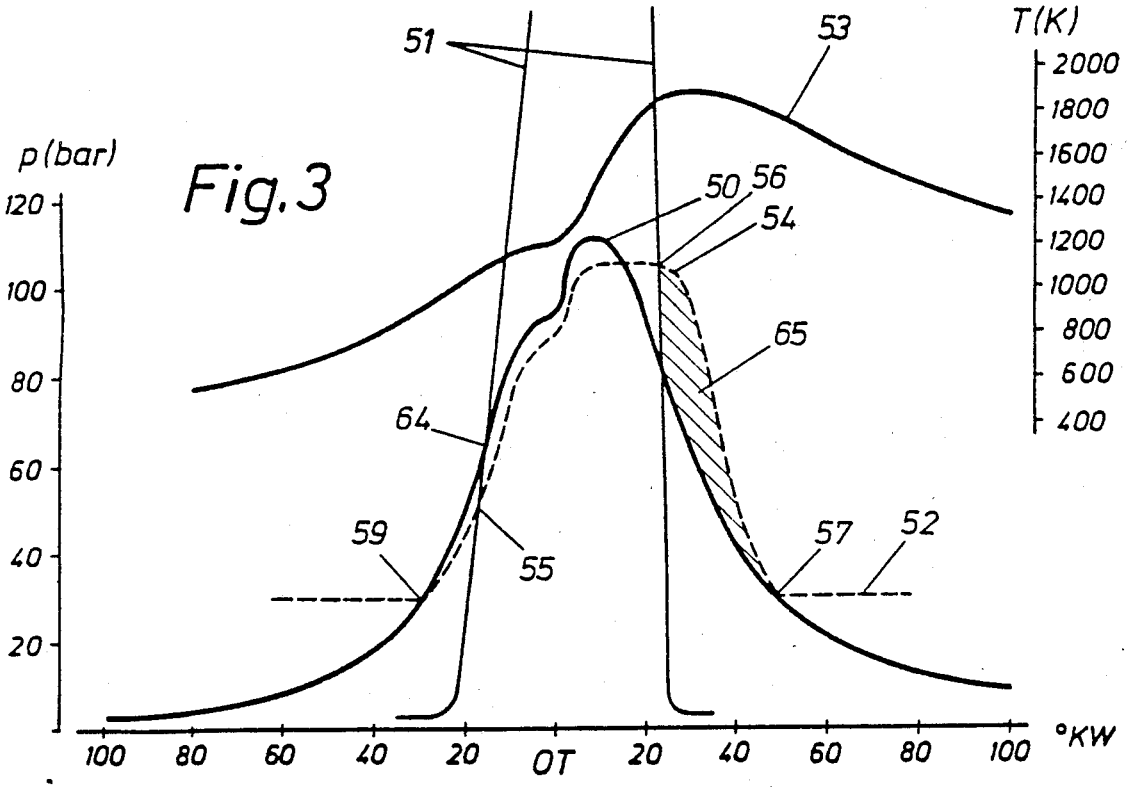
FIG. 3 presents characteristic curves explaining the injection process according to the invention.

FIG. 3 presents pressure p(bar) and temperature T(K) curves as a function of the crank angle °KW. In this diagram 50 denotes the pressure in the cylinder, 51 the injection pressure, 54 the pressure of the compressed air in the air cell 4 and in the connecting lines, and 52 the residual pressure in the injection system. The temperature curve in the cylinder is marked 53.

During fuel injection the connection between the air cell 4 and the nozzle bores 58 is closed between points 55 and 56 by the check valve 11 (FIG. 1) and the cylindrical slide 63 (FIG. 4); it will open after point 56 only, and between points 56 and 57 air from the air cell 4 will flow into the injection system through line 8, and into the cylinder chamber 1 through bores 10, 13 and 41 via nozzle bores 58. The dimensions of the spring 21 are such that the residual pressure in the injection system approximately corresponds to the value represented by the horizontal branches 52, which means that the fuel needle 15 and the relief valve 33 will close at this pressure. After point 59 a comparatively small amount of air will flow through the check valve 11 until the injection pressure of the fuel has risen and the valve closes at point 55 with the beginning of fuel injection. Between points 56 and 57 air will stream through the nozzle bores 58 into the combustion chamber; during this phase the space around the relief valve 33 and the bore 39 will remain filled with fuel. This is due to the surface tension of the fuel and the very short period during which air is blown in.

At the beginning of fuel injection the cross-bore 40 and the axial bore 41 as well as the nozzle bores 58 fill up with fuel; the air in bore 13 and in the space around the second check valve 11 is compressed by the fuel to a very small volume as a consequence of the high pressure of injection. Thus fuel injection takes place between points 55 and 56, while air is injected between points 56 and 57.

The injection system is supplied with fuel via bore 31 which is closed by the sloping edge 30 of the pump plunger in the usual way. In order to prevent overheating of the check valve 2 it may be placed further along the bore 3 such that it is located within the cylinder head. In this instance part of the bore 3 will lead from the cylinder chamber 1 to the check valve 2 which will be located in the cooled part of the cylinder head.

Since the compressed air which has been taken from the cylinder chamber 1 and stored in the air cell 4 should return to the cylinder chamber without having cooled off parts of the air system, above all the air cell 4, may be heat-insulated, The quantity of air which is blown in after injection of the fuel may be varied with the dimensions of the air cell 4 and the check valve 2. It will also be possible to vary the volume of the air cell 4 during operation, for instance by moving a fitted plunger, in order to achieve certain effects.

According to the invention the method of blowing in air by means of the pump/nozzle unit shown in FIG. 1 can also be used for an injection system in which pump and nozzle are configured separately. In this instance the air cell and the necessary check valves are located in the vicinity of the nozzle, and the pump is connected to the nozzle via an injection line.

Figure 4:
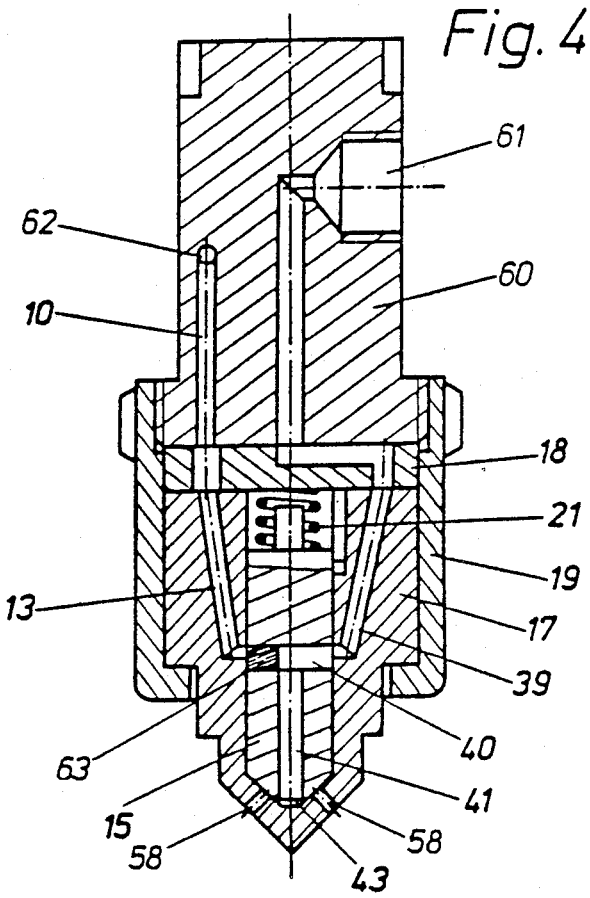
FIG. 4 shows a device for delivery of fuel and compressed air into a combustion chamber according to a second embodiment of the invention.

The nozzle unit presented in FIG. 4 of an injection system with a separate pump and nozzle, comprises a nozzle body 60 with connection 61 for the injection line arriving from the injection pump, and connection 62 for the air feeder line. As regards the remaining part of the nozzle, the configuration is similar to that in FIG. 1, and identical parts have identical reference numbers. The only difference is that cross-bore 40 contains a cylindrical slide 63 which is in the left position shown here during fuel injection.

As soon as the injection process has ceased and the air pressure in bore 13 is higher than the fuel pressure, the cylindrical slide 63 moves to the right, thus opening the axial bore 41 for the entrance of air which will press the fuel still remaining in the axial bore 41 and the nozzle bores 58 into the cylinder chamber, and will then flow into the cylinder chamber 1 through the nozzle bores 58. This process of blowing in air ends once the pressure in the air system has dropped to the level of the residual pressure 52—cf. point 57 in FIG. 3. The cylindrical slide 63 thus effects a separation of the air system and the fuel system in the injection nozzle, and is automatically actuated by the fuel pressure on the one hand and the air pressure on the other. The fuel needle 15 must be prevented from turning by a suitable device.

This device can also be used for pump/nozzle units, of course.

Presentation of the pressure and temperature curves as a function of the crank angle as in FIG. 3 also applies to the variant according to FIG. 4, the cylindrical slide 63 being in the left position after point 55 and in the right stop position after point 56. The fuel needle 15 is lifted from its seat between the points 64 (open) and 57 (close). The hatched area 65 in FIG. 3 indicates the range of pressures and crankshaft angles within which air injection takes place.

The device according to the invention is suited for both an integrated pump/ nozzle unit and a separate pump and nozzle system in which the beginning and end of the injection process are controlled electrically.

I claim:

1. An apparatus for sequentially injecting charges of fuel and compressed air into a combustion chamber of a diesel engine, said apparatus comprising a nozzle body which has a first end and a second end and which can be connected to a cylinder head of a diesel engine such that its second end communicates with a combustion chamber in said cylinder head, said nozzle body including a central bore which extends from said first end towards said second end, a plurality of nozzle bores at its second end which extend between said central bore therein and an outer surface thereof, and first and second separate feeder bores which communicate with said central bore, said first feeder bore carrying compressed air and said second feeder bore carrying fuel, a fuel needle positioned in said central bore, said fuel needle including a cross bore which communicates with both said first and second feeder bores in said nozzle body and an axial bore which extends from said cross bore to an end thereof adjacent said nozzle bores, and control means in said cross bore of said fuel needle for controlling whether the central axial bore in said fuel needle is in communication with said first feeder bore or said second feeder bore based on the relative pressures of compressed air in said first feeder bore and fuel in said second feeder bore, passage of a charge of compressed air through said axial bore in said fuel needle and then through said nozzle bores causing fuel remaining therein to be conveyed into said combustion chamber.

2. An apparatus according to claim 1, wherein said control means comprises a slide which is movably positioned in said cross bore.

3. An apparatus according to claim 1, including a second one-way check valve which can be mounted in a cylinder head of a diesel engine, an air cell, first connection means for connecting said one-way check valve with said air cell and second connection means for connecting said air cell with said first feeder bore in said nozzle body.

* * * * *